United States Patent [19]

Dudley et al.

[11] 4,354,466

[45] Oct. 19, 1982

[54] IDLE SPEED CONTROLLER

[75] Inventors: Carl K. Dudley, Petersburg, Mich.; William J. Roberts, Toledo, Ohio

[73] Assignee: Eltra Corporation, Toledo, Ohio

[21] Appl. No.: 271,749

[22] Filed: Jun. 8, 1981

[51] Int. Cl.[3] ..... F02D 1/04

[52] U.S. Cl. ..... 123/339; 123/360; 123/361

[58] Field of Search ..... 123/339, 352, 360, 361

[56] References Cited

U.S. PATENT DOCUMENTS

| | | | |
|---|---|---|---|
| 4,056,082 | 11/1977 | Noiles | 123/339 |
| 4,237,833 | 12/1980 | Des Lauriers | 123/339 X |
| 4,305,360 | 12/1981 | Meyer et al. | 123/339 |
| 4,306,527 | 12/1981 | Kinugawa et al. | 123/339 |

*Primary Examiner*—Tony M. Argenbright
*Attorney, Agent, or Firm*—James P. DeClercq

[57] ABSTRACT

An idle speed control system for controlling the idle speed of an internal combustion engine, to conserve fuel by allowing a lowered idle speed, whenever possible, as well as offering more than normal power when needed, is disclosed. This idle speed control system includes an actuator for moving a secondary idle stop member into operative position, having both a vacuum-operated section and a solenoid section for maintaining the actuator in operative position, regardless of the state of the vacuum-operated portion. The idle speed control system further includes a control circuit responsive to engine speed which applies an output signal to the vacuum-operated section of the actuator when engine speed falls below a predetermined minimum, maintains it for a predetermined period of time, momentarily removes it to determine if the engine is presently capable of idling above the predetermined minimum speed, and reapplies the output signal if engine speed then dips below the predetermined minimum speed. Once applied, the output signal is removed either by the timer function, or when engine speed increases above the predetermined maximum idle speed. The control circuit also provides a signal to the solenoid portion of the actuator, in response to predetermined major accessory loads which may be imposed upon the engine in a vehicle.

10 Claims, 3 Drawing Figures

IDLE SPEED CONTROLLER

BACKGROUND OF THE INVENTION

The invention relates generally to the field of idle speed controls. In particular, the invention relates to a control circuit for an idle speed controller for adjusting the idle speed of an internal combustion engine so as to conserve fuel during engine idle time, while offering greater than normal power when needed.

The fuel usage of an engine during idle, as at other times, is largely determined by engine speed. Engine speed influences the volumetric flow rate of the fuel-air mixture, and the internal friction and drag losses in the engine. Fuel usage at idle is a significant factor in fuel economy, both because fuel is expended without producing vehicle movement, and because an idle mixture must be a comparatively richer mixture of fuel to air to insure combustion, the mixing effect of higher engine speeds not being present, and the higher rotational momentum of higher engine speeds which tends to keep the engine in operation is not present.

Simply lowering the idle setting would conserve fuel, but with this there are certain conditions where the engine would be in danger of stalling. Such conditions include heavy electrical loads which are imposed on the engine through the generating system, as well as including the time when the engine has not yet achieved normal operating temperature after start-up.

A conventional internal combustion engine for an automobile has a throttle valve in an intake air passage of a carburetor, for control of the amount of air supply to the engine, the carburetor mixing fuel with the air in a predetermined ratio, the output power and rotational speed of the engine being controlled by the amount of fuel mixture per unit time. The throttle valve is opened and closed under the mechanical control of a throttle pedal, so that a driver may cause the vehicle to accelerate and decelerate. When the accelerator pedal is released, typically one or more springs cause the throttle plate to be moved to a substantially closed idle position. The movement of the throttle plate to its closed position is controlled by an idle stop, including a fixed stop member on the engine, and a moving stop member affixed to the throttle plate shaft, and generally containing an adjustment screw for cooperating with the fixed stop member to set the idle speed by regulating the position of the throttle plate.

Due to the large number of accessory loads in a modern automobile, together with the lack of manifold vacuum to support fuel mixture intake caused by pollution control accessories, it is often necessary to set the basic idle speed of an autombile internal combustion engine in excess of 1,000 RPM. This is necessary to insure that the engine will not stall when it is cold, will not stall when large electro-mechanical loads such as an air conditioner is imposed, when larger electrical loads such as fans and resistance heaters are imposed on the generating system, or when larger mechanical loads such as power steering are imposed on the engine at idle. Also, when the throttle plate is suddenly returned to its idle position, manifold vacuum increases sharply, causing a momentary variation of fuel mixture, the mixture becoming momentarily richer and unable to deliver optimum power. Then, the idle speed drops sharply, and the engine may stall if a high idle setting is not provided.

Various fast idle means operated by a bimetallic spring have been used to provide a cold idle stop position in conjunction with the operation of a choke valve in the carburetor, to provide a higher idle speed when the engine is cold, to compensate for poorer fuel vaporization and increased lubricating oil drag. Such cold idle devices are usually arranged so that the operator must press the throttle pedal to allow a cold idle stop member to be released after the engine has begun to warm up, so that, if the throttle pedal is not depressed, the engine will obtain an extremely high idle speed as it attains operating temperature, wasting fuel.

Various forms of servo mechanism systems have been proposed to avoid such deficiencies and maintain a substantially constant idle speed in the presence of varying engine temperature, intermittent accessory loads, and sudden throttle closing, especially where the mixture caused by a sudden throttle closing would result in emission components in excess of loads that can be successfully processed by emission control accessories.

Such servo mechanisms share a common deficiency of all mechanical servo mechanisms. The relatively complex structure necessary to achieve infinitely variable position of a mechanical element is prone to fail, and not suitable for extended, unmaintained use in a modern automobile. Also, such devices, in attempting to maintain a constant idle speed, do not allow the engine to idle at the lowest possible speed, as long as engine speed does not decrease below a predetermined minimum idle speed and do not provide for an increase in idle speed to allow a generator to provide sufficient output to meet a heavy electrical load. The instant invention overcomes the numerous deficiencies and problems of these previous approaches to controlling idle speed.

SUMMARY OF THE INVENTION

The invention is an electrical control circuit responsive to engine speed, as derived from an ignition system signal such as an ignition coil primary voltage and responsive to the presence of significant accessory loads which are electrically energized, to control an actuator which provides a secondary idle stop member which may be positioned to either an operable or inoperable position.

The actuator has a vacuum diaphragm section and a solenoid section, operating a common control member. The vacuum actuator is so constructed as to move the secondary idle stop between its operative and inoperative positions in a stepwise manner, a high vacuum source such as the intake manifold of an idling internal combustion engine being applied to, and removed from, the vacuum diaphragm member by a solenoid valve. The solenoid portion of the actuator uses the known principle that the force of a solenoid increases as it nears its position of minimum reluctance, to provide a solenoid which is incapable of moving the secondary idle stop member to its operative position, but, once in operative position, has sufficient force to maintain it there. Of course, the control circuit as disclosed has other possible uses, such as in controlling a variable between limits in continuous flow devices, but, in the preferred embodiment, it provides a first output, dependent on engine speed, to the solenoid valve supplying the vacuum actuator, and a second output, responsive to electrical loads upon the engine for energizing the solenoid coil of the actuator. A temperature switch, such as a coolant temperature switch, is also provided to actuate the solenoid valve.

Therefore, if the engine is cold, the secondary throttle stop will be moved to its operative position, and will be allowed to move to its inoperative position after the engine is warm, assuming no significant electrical loads are present. Such significant electrical loads, or electrically-related loads, include, in the illustrated use of the invention, a vehicle air conditioner, a conventional resistance heater for heating engine intake air to provide better fuel vaporization when the engine is not fully warmed and a rear window heater for heating the glass of the rear window to remove condensation and snow and ice.

In an exemplary system embodying the invention, the internal combustion engine has a desired idle speed of 500 RPM, adjusted by adjusting the conventional fixed idle stop with the engine warm and not under load. The movable secondary idle stop of the system embodying the invention is set to maintain an idle speed of 1200 RPM under the same conditions. The minimum desired actual idling speed is approximately 430 RPM, the lowest speed at which a typical engine used together with a system embodying the invention will idle. Also, the maximum desirable idle speed is chosen to be 1,000 RPM.

In a control circuit according to the invention, a control signal for the actuator is supplied to move the secondary movable throttle stop to its operative position and provide an increase in throttle opening for continued engine operation whenever engine idle speed drops below approximately 430 RPM, and is maintained for a short period of time, since the drop in idle speed may have been due to a transitory condition such as a sudden closing of the throttle. After a short time, the control circuit removes the control signal, to determine if the engine is able to maintain a satisfactory idle RPM at a lowered throttle opening. If the engine idle speed again drops below approximately 430 RPM, the control signal will be reapplied, and will continue to energize the actuator to maintain the movable secondary throttle stop in position, until, by removal of load or by operation of the throttle pedal, the operator has caused engine RPM to exceed approximately 1,000 RPM. In an actual physical embodiment of the invention, the lower trigger level speed is in a range of 425 to 440 RPM, and the upper trigger level speed is in a range of 950 to 1150 RPM. In operation, upon start-up, the secondary idle stop will be maintained in operative position by a temperature switch such as a coolant temperature switch. After an engine temperature such as the coolant temperature is above, for example, 55° F. (13° C.), the idle setting will be allowed to go to its lower position, provided the electrically energized accessory loads are not applied. As will be apparent, upon initial starting of the engine, the RPM will be below 430, the manifold vacuum will be high, and the control circuit will energize the solenoid valve to apply that vacuum to the vacuum actuator to activate the secondary movable throttle stop. If, in the preferred and illustrated embodiment, the vehicle air conditioner, intake air heater, or rear window heater is energized, the solenoid portion of the actuator will maintain the secondary movable idle speed stop in its operative position regardless of engine speed or manifold vacuum. When all significant electrical loads are removed, the control circuit provides additional throttle opening at idle only when appropriate for the situation.

According to the illustrated embodiment of the invention, idle speed control involves two trigger levels, two memory elements, and a timer which can provide an unlatching function. The trigger levels, upper and lower, together with one of the memory elements can be understood as a turn-on low trigger level and a turn-off upper trigger level, in a manner similar to that of a device having hysteresis, disregarding the action of the timer. In other words, if the idle speed goes below the low trigger level, the solenoid valve will be on, providing vacuum to the vacuum actuator to pull or push the secondary movable idle stop to its high speed position. It will remain at that position until the engine speed reaches the upper trigger level, or until the timer provides an unlatching function for the memory element that provides the equivalent of hysteresis.

The normal speed of the unloaded internal combustion engine when at the high idle setting, after having reached thermal equilibrium, will be high enough to reach the upper trigger level, so as to prevent the unnecessary waste of fuel under normal idle conditions. If due to loading, the engine idle speed is prevented from reaching the upper trigger level, then it remains at the high setting, providing the needed additional power, and avoiding the return to the low setting, where the loading could cause the engine to stall. If, while idling at the lower setting, there should come for any reason a slowing of the engine, the control circuit will instantaneously sense the speed falling below the low trigger level and provide additional fuel by opening the throttle. As stated above, there are occasions when engine speed may dip temporarily without the need for sustained additional power, such as upon a sudden stop. On such an occasion, it is desired to give the engine extra power, for enough time to recover, and then return to the low idle setting, without the need for accelerating the engine to the upper trigger level. In the illustrated embodiment of the invention, the timer performs this function. It will cause the high setting to be removed about one second after it is initiated. In order to avoid continual oscillation of the throttle plate between the two positions set by the fixed idle stop and the movable idle stop, a memory is provided to allow the engine to return to the low idle setting only once during each idle period. This memory is reset by the idle speed being raised above the upper trigger level, either by operation of the throttle pedal, or by removal of the load which caused the initial dip in speed. The two trigger levels, and the corresponding idle settings, are chosen so as to give maximum fuel savings without sacrificing engine performance.

Therefore, it is a primary object of the invention to provide a control signal for an actuator for stepwise moving an idle speed stop member for opening a throttle valve a predetermined amount, the control signal being applied when engine idle speed falls below a predetermined minimum speed or lower trigger level, being maintained for a predetermined time thereafter, and then being removed after the predetermined time, and being reapplied if the idle speed falls below the predetermined minimum speed or lower trigger level, and being maintained there after until idle speed rises above a predetermined maximum speed or upper trigger level. It is an advantage of the invention that idle speed may be maintained with a minimum throttle opening and minimum fuel expenditure. It is a feature of the invention that the actuator stepwise moves a secondary idle stop member into operative position, using a minimum of proven components, resulting in an inexpensive, rugged and dependable system.

It is a further object of the invention to provide an idle speed control system wherein a single movable element controls throttle plate idle opening and engine idle speed.

DETAILED DESCRIPTION OF THE INVENTION

Figure 1:
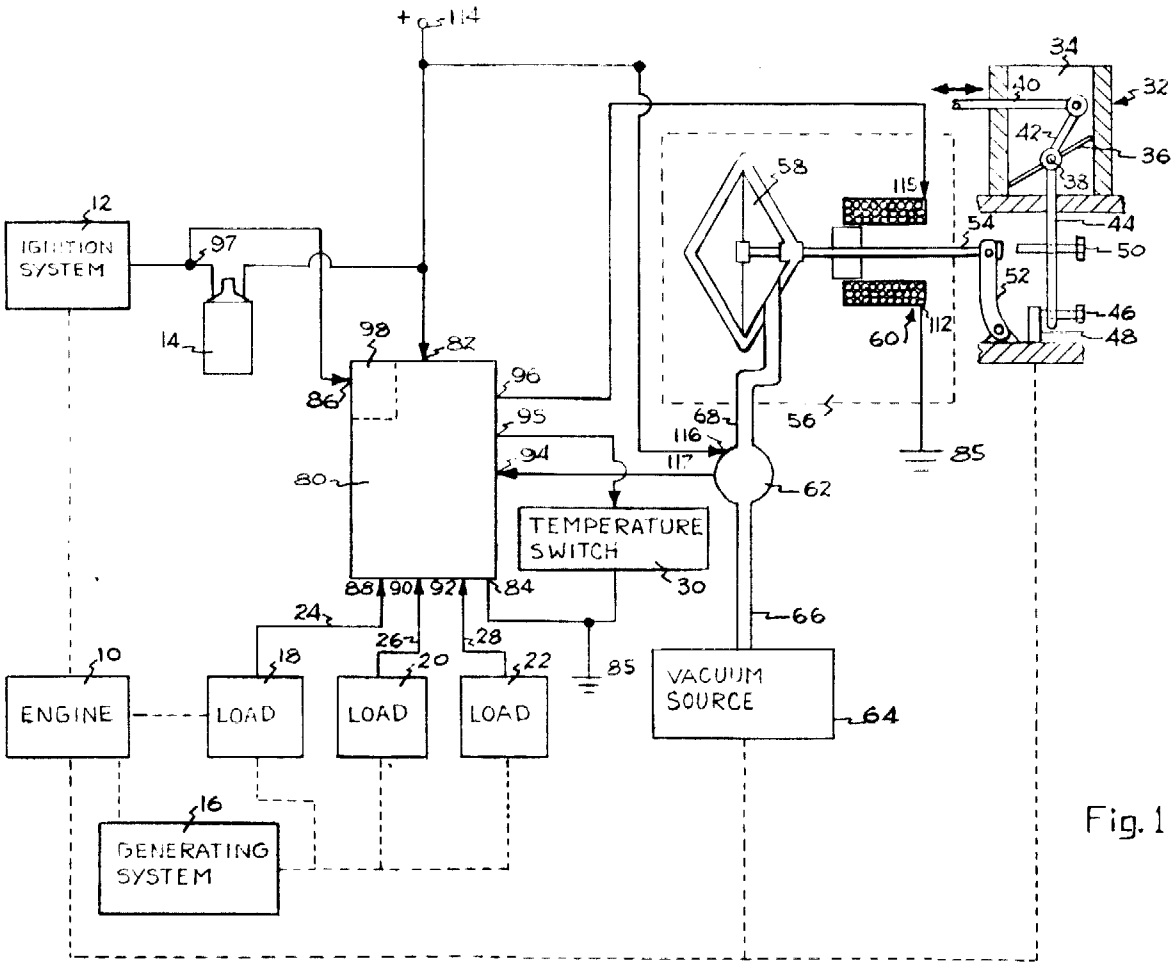
FIG. 1 is a symbolic illustration of an idle speed control system according to the invention.

Referring to FIG. 1, a partially symbolic illustration of a system embodying the invention is shown. An engine 10 is shown provided with an ignition system 12 including an ignition coil 14, and having a generating system 16. As illustrated, three significant accessory loads 18, 20 and 22 may be driven by engine 10, either mechanically, or both mechanically and electrically through generator system 16. In an actual vehicle utilizing the preferred embodiment of the invention, load 18 is the air conditioning system, load 20 is a resistance heater embedded in the rear window or backlight of the vehicle, and accessory load 22 is a resistive intake air heater, for heating the air supplied to the vehicle carburetor to improve fuel vaporization for emission-control purposes until the engine exhaust manifold has heated sufficiently to be used for warming air supplied to the carburetor. These loads are the most significant accessory loads imposed upon an engine, and, as will be apparent, two of them are energized when the engine is cold and most likely to stall. The illustrated accessory loads are electrically energized, so that electrical signals indicating their status are available on lines 24, 26 and 28. Also, a temperature switch 30 is provided to provide an indication that the engine is cold, and liable to stall. In an actual embodiment of a system according to the invention, temperature switch 30 is an engine coolant temperature switch actuated at 55° F. (13° C.), although other indications of engine temperature may be conveniently used, depending on engine construction, such as oil temperature, intake manifold temperature, manifold crossover passage temperature, engine head temperature, and so forth.

Engine 10 is shown as including a carburetor assembly 32, for purposes of illustration. The invention is also applicable to, for example, fuel injected engines of the spark ignition or compression ignition type, by varying the idle position of the actuator rod for an injection pump or the like. Carburetor assembly 32 has a bore 34, and a throttle plate 36 interposed in the bore, for controlling the amount of air, and thus the amount of fuel, supplied to engine 10. Throttle plate 36 is mounted on throttle shaft 38, which is rotatably actuated by control rod 40, through linkage portion 42. Control rod 40 is connected to an accelerator or throttle pedal of a vehicle or the like, so that an operator may control the speed of the engine of the vehicle. Conventionally, throttle shaft 38 is also fitted with a linkage portion 44 fitted with an adjusting screw 46, cooperating with a fixed idle stop member 48, for allowing throttle plate 36 to remain slightly open when the throttle pedal is released by the operator, to set an engine idle speed and prevent the engine from stalling. If desired, although not necessary with the invention, idle stop member 48 may also be provided with a dash pot or vacuum actuated throttle opener, or the like, to prevent the throttle plate 36 from closing bore 34 too quickly. Although movable, either through the action of the dash pot or by reason of a vacuum passage in the throttle opener, these devices quickly arrive at a fixed position, and may be considered fixed idle stop members for purposes of dynamic control of engine idle speed.

In accordance with the invention, carburetor assembly 32 is provided with a second adjustment means such as adjustment screw 50 associated with a linkage such as linkage portion 44, cooperating with a secondary movable idle stop member 52, pivotably mounted to carburetor assembly 32 of engine 10. Idle stop member 52 may be moved into operative position, to provide an increased engine idle speed by either restraining throttle plate 36 from moving towards its normal idle position as it closes, or it may open throttle plate 36 when it is in its normal idle position. Second movable idle stop member 52 is controlled by actuating rod 54 of an actuator 56. As illustrated, actuator 56 has means for moving idle stop member 52 to operative position, and means for maintaining it at that position thereafter, regardless of the state of the means responsible for initially moving it to the operative position. In the embodiment illustrated, a vacuum diaphragm actuator 58 is connected to actuator rod 54, through solenoid 60. In the illustrated embodiment, solenoid 60 is constructed in a manner to reduce the strength of its magnetic field so that it does not have sufficient power to move rod 54 and idle stop member 52 to operative position, but does have sufficient power to maintain it there. This may be accomplished in conventional manner, such as by winding, by the use of flux shunts, or by the use of a stepped core section. Vacuum is supplied to actuator 56 through a solenoid valve 62 from a vacuum source 64, which may be the intake manifold of engine 10 or any other suitable source, through passages 66 and 68.

According to the preferred embodiment of the invention, a control circuit 80 is provided, having a power supply connection 82, a ground return connection 84, connected to ground 85 a speed signal input 86, accessory load inputs 88, 90 and 92, a first control signal output 94, a temperature switch input 95, and a second control signal output 96. In the illustrated embodiment of the invention, a speed signal is provided to speed signal input 86 from the primary connection 97 of ignition coil 14, and is processed by input section 98 into a form usable by the illustrated embodiment of control circuit 80. As will be apparent, there are numerous sources of signals which may be used in a system according to the invention, which would require modification of input section 98. As is known, in the illustrated embodiment, the primary of an ignition coil carries a signal which may be characterized as a square wave with an extremely high amplitude leading edge pulse, followed by ringing. Other sources such as magnetic sensors and photoelectrical sensors disposed adjacent rotating members have different output signals, and would require different treatment.

As illustrated, solenoid 60 has a terminal 112 connected to a ground return 85 and a terminal 115 connected to second control signal output 96, and solenoid valve 62 has a terminal 116 connected to power supply line 114, and a terminal 117 connected to first control signal output 94. As will become apparent, second control signal output 96 provides an activating source line for solenoid 60 in response to conditions appearing at accessory signal inputs 88, 90 or 92, and first control signal output 94 provides a ground return for solenoid valve 62 in response to the speed of engine 10. The temperature switch 30 also supplies a ground return to solenoid valve 62 through temperature switch input 95. Therefore, solenoid valve 62 will be energized when the temperature switch is closed, or when appropriate speed conditions exist as directed by speed signal 86 and logic functions of control circuit 80. Similarly, solenoid 60 will be energized when appropriate conditions exist at accessory signal inputs 88, 90 and 92, to maintain idle stop 52 in its operative position once it has been moved there by vacuum diaphragm actuator 58 in response to first control signal output 94. As will be apparent, when the engine 10 is initially started, its speed will be low, and it will have a high manifold vacuum which may be used as vacuum source 64, so that vacuum diaphragm actuator 58 will initially push idle stop member 52 into operative position, where it will be maintained under appropriate circumstances once the engine has achieved idle. Thereafter, in the absence of overriding conditions caused by temperature switch 30 or loads 18, 20, or 22, solenoid valve 62 will be actuated intermittently, to control the position of second movable idle stop member 52 as appropriate to minimize idle speed and conserve fuel.

Figure 2:
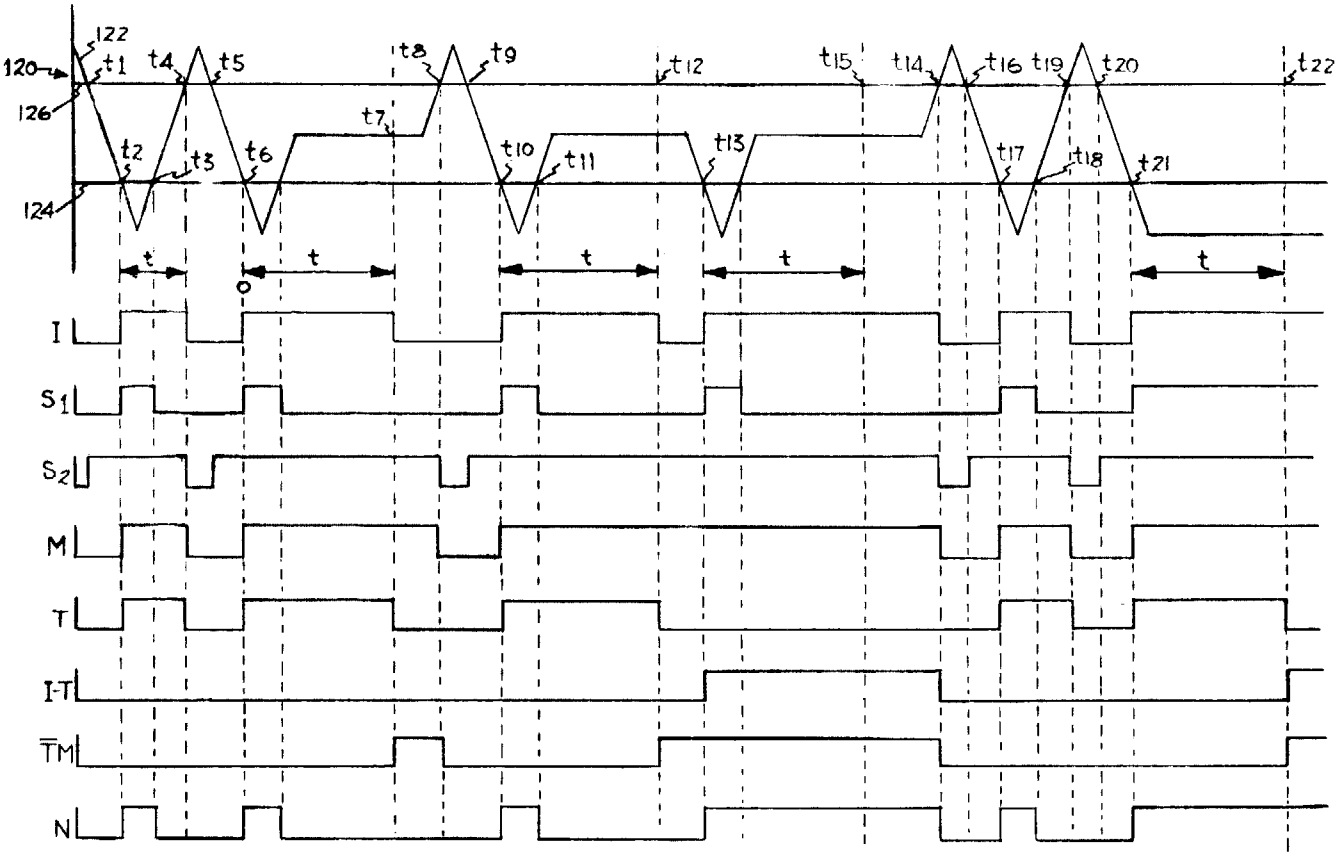
FIG. 2 illustrates a hypothetical engine speed cycle, a corresponding desired control signal output, and a logic timing diagram showing idealized signal waveforms of the logical components of the control signal.

FIG. 2 is a composite illustration showing hypothetical engine speed curves versus time, a desired output I from first control signal output 94, and idealized input signals and intermediate logic step signals. Also shown are signals not developed in an actual physical embodiment of the invention for purposes of the explanation of the operation of a control circuit according to the invention.

In terms of logical equations, the preferred embodiment of the invention may be characterized as follows:

$$M = S1 + S2M$$

$$N = S1 + \bar{T}MN$$

$$I = T + \bar{T}MN$$

Wherein M is a first memory function, S1 and S2 are indicative of the lower and upper trigger levels, respectively, N is a second memory function, T is a timer function and I is the desired output. As will be seen from inspection of FIG. 2, these equations, and the resulting circuit, may be simplified. Among other things, it will be noted that, in the preferred embodiment, memory function M may be ignored for purposes of determining the final output, and that some signals are effective only during positive, or only during negative transitions, so that their opposite transitions need not be considered or developed.

Referring to FIG. 2, there is shown a hypothetical graph 120 of engine speed versus time, showing engine speed 122 varying above and below an idle speed range defined by a lower trigger level 124 and an upper trigger level 126. As previously explained, lower trigger level 124 is approximately 430 RPM, and upper trigger level 126 is approximately 1,000 RPM in the preferred embodiment of the invention. The hypothetical graph 120 does not attempt to portray actual engine speeds in a linear manner, but is for explanation only.

At a time shown as time t1, engine speed is decreasing through upper trigger level 126. At this time, logic signal S2 rises, and, in logical terms, indicates that engine speed is not above the upper trigger level limit. At time t2, engine speed has continued to drop, and falls through the lower trigger level, activating logic signal S1, which indicates that engine speed is below 430 RPM. This causes a transition in logic signal M. As illustrated, logic signal M indicates which of the trigger levels was last crossed by engine speed with logic signal M being in a high voltage state if lower trigger level 124 were the last trigger level crossed by engine speed, and in a low voltage state if upper trigger level 126 were the last trigger level crossed. Output signal I, appearing at first output 94 in FIG. 1, changes to its high voltage state to increase throttle opening. This is immediately followed by a change in engine speed caused by the vehicle operator, as if the vehicle had been momentarily slowed by releasing the throttle pedal to make a slight adjustment in vehicle speed. The engine speed rises, crossing lower trigger level 124 at time t3 and upper trigger level 126 at time t4, logic signal S1 becoming low when engine speed increases above the lower trigger level 124, and logic signal S2 becoming low when engine speed exceeds the upper trigger level 126. Logic signal M, indicating the last crossing, responds appropriately. Timer function T, initiated by engine speed dropping below lower trigger level 126, is reset when engine speed increases above upper trigger level 126, and logic signal N, caused to become a high voltage at time t2, reverts to its low state at time t3.

Thereafter, engine speed decreases through upper trigger level 126 at time t5 and falls below lower trigger level 124 at time t6, as though the throttle had been suddenly closed after the engine had been operated at a higher speed for a substantial period of time. Logic signal S1 indicates that idle speed is below lower trigger level 124, causing a corresponding change in logic signal M, and initiating timer function T which holds output signal I in its high state for at least a preset time (unless engine speed rises above upper trigger level 124 before the end of preset time t, resetting timer function T), and thereafter allows logic signal I to return to its low state. This function provides momentary idle speed support to keep the engine from stalling when the throttle plate is suddenly closed after engine 10 has become stabilized at a higher speed. Engine speed remains between upper trigger level 126 and lower trigger level 124 when output signal I becomes low at time t7. Thereafter, the engine is accelerated, causing upper trigger level 126 to be crossed in an upward direction at time t8, and recrossing it in a downward direction at time t9. Logic signal S2 and M react as previously described.

As shown, engine speed continues to fall, crossing lower trigger level 124 at time T10. Immediately, output signal I is provided to increase the throttle opening, and engine speed rises above lower trigger level 124 at time t11. Meanwhile, timer function T has been initiated, and maintains output signal I in its high voltage state for the predetermined time t. In the hypothetical graph 120 shown, engine speed 122 decreases after output signal I is removed at time t12, as if being affected by a number of simultaneous minor accessory loads, or being affected by a vehicle with an automatic transmission being stopped on an incline, or being affected by a power steering pump or the like in use. This causes engine speed to decrease and fall through the lower trigger level 124 at time t13. In response, output signal I is immediately switched to its high voltage state, where it remains until engine speed crosses the upper trigger level 126 at time t14, and not at a time t15 occurring a predetermined time t after time t13. This is to prevent repetitive variations in engine speed such as might occur should the engine be idling with a number of minor accessory loads, such as headlights, taillights, and additional radio equipment simultaneously energized. This feature is provided by memory function N which is effectively set by logic signal S1 and reset by logic signal M, in response to logic signal S2 at time t14.

Thereafter, in hypothetical graph 120, the cycle of times t1 through t6 repeats at times t16 through t21, the engine speed falling through the lower trigger level 124 at time t21. Output signal I is applied at time t21, and maintained until time t22 by the output of timer function T, and maintained thereafter by memory function N, since engine speed 122 has not increased above lower trigger level 124. This function provides for increased throttle opening for continued engine operation, if possible, even when the loads imposed on the engine 10 will not allow it to idle smoothly at the desirable speed above lower trigger level 124.

Logic signal I-T is provided to illustrate the difference between the output of timer function T and the desired output signal I. The signal to fill in this difference is provided with memory function signal N, which has no effect when output signal I is at a high voltage level from other causes. Logic signal $\overline{T}$ M is illustrated to show that logic signal N must be developed, because combinations of previously-developed signals do not provide all necessary transitions at appropriate times.

Thus the output may be obtained with T+N but it is useful in the preferred embodiment to use the expression $I=T+\overline{T}MN$ since $\overline{T}MN$ is more easily accessible. A truth table would show these two expressions to be equivalent except for the impossible case where M+0 while N=1.

Figure 3:
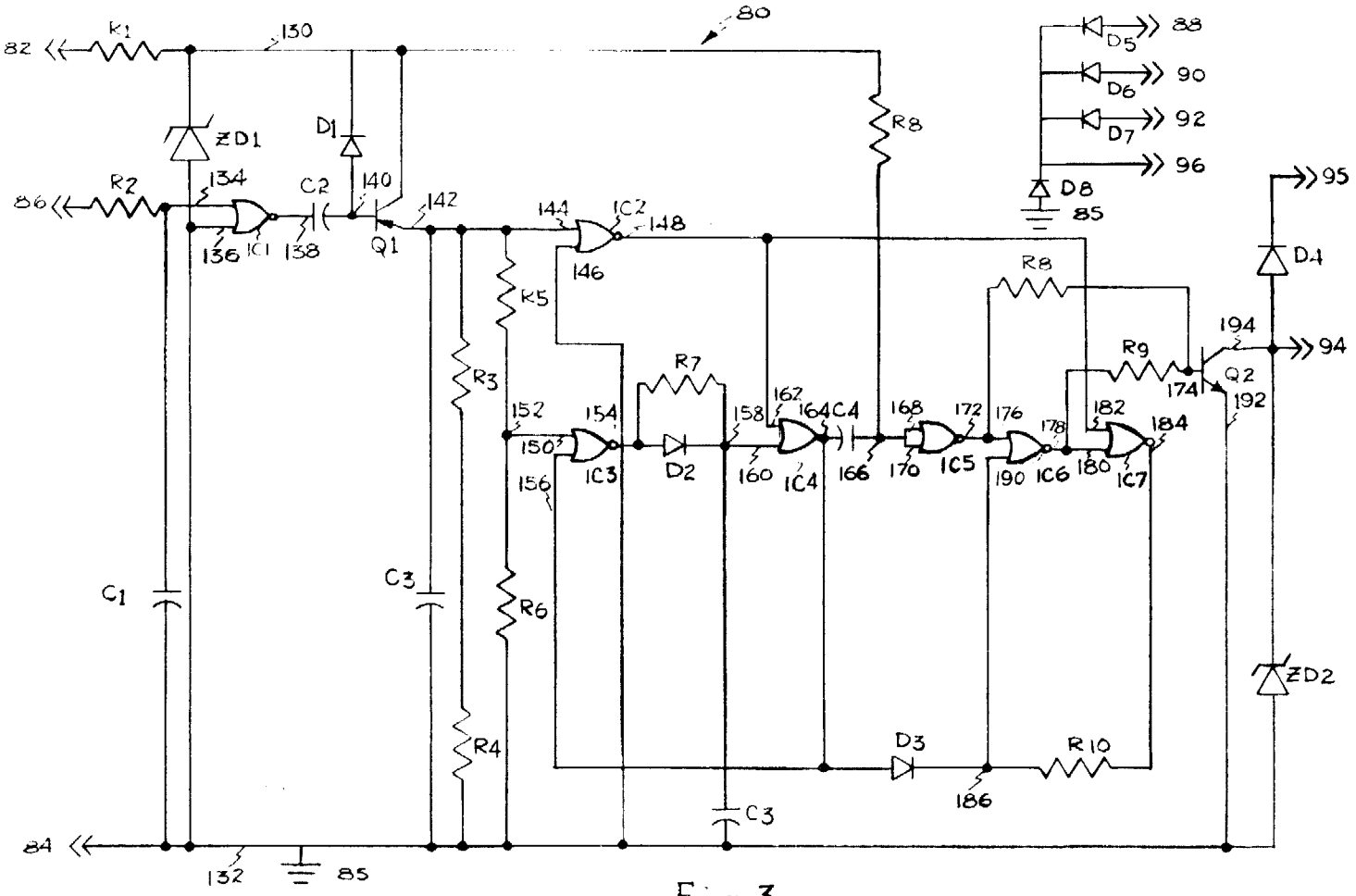
FIG. 3 is a schematic diagram of a control circuit according to the invention.

FIG. 3 shows a control circuit according to the invention. Input and output connection points are numbered as shown in FIG. 1, with power supply connection 82 connected to power supply 114, ground return connection 84 connected to ground 85, speed signal input 86 connected to primary terminal 97 of ignition coil 14, accessory signal input 88, 90 and 92 connected to loads 18, 20 and 22, temperature switch input 95 connected to temperature switch 30, first control signal output 94 connected to terminal 117 of solenoid valve 62, and second control signal output 96 connected to terminal 115 of solenoid 60 of actuator 56.

As shown, a resistor R1 is connected between power supply connection 82 and power supply line 130. Ground return connection 84 is connected to ground line 132. A zener diode ZD1 is connected between power supply line 130 and ground line 132, for regulating the voltage supplied to circuit 80. Resistor R2, capacitor C1, integrated circuit logic NOR gate IC1, capacitor C2, diode D1 and transistor Q1 constitute an input section 98 as shown on FIG. 1. Resistor R2 is connected between speed signal input 86 and input 134 of IC1. Capacitor C1 is connected between input 134 and ground line 132. A second input 136 of logic gate IC1 is connected to ground line 132. The output 138 of logic gate IC1 is connected to a first end of capacitor C2. The opposite end of capacitor C2 is connected to the anode of diode D1, having its cathode connected to power supply line 130. Junction 140 between capacitor C2 and diode D1 is also connected to the base of a transistor Q1. Transistor Q1 has its collector connected to power supply line 130, and its emitter connected to line 142. A capacitor C3 is connected between line 142 and ground line 132.

Resistor R2 and capacitor C1 serve as an input filter for the signal connected to speed signal input 86. In the embodiment illustrated, such an input signal may be characterized as a square wave having a leading edge with an extremely high voltage overshoot portion, followed by inductive ringing. Resistor R2 and capacitor C1 attenuate this leading edge portion of the input signal, and condition the input signal to be applied to input 134 of logic IC1. Logic gate IC1, acting as an inverter, provides an inverted square wave at output 138. Capacitor C2 operates as a differentiator, providing positive and negative pulses. The positive pulse is not used. Transistor Q1 is connected oppositely to conventional fashion, for providing a low gain transistor. The resulting pulse appearing at the emitter of transistor Q1 is applied to capacitor C3, connected between line 142 and ground line 132. The series combination of resistors R3 and R4 are connected across capacitor C3. As will be apparent, a sawtooth waveform appears on line 142.

Although any DC or sawtooth level appearing on line 142 would be usable with the circuit illustrated, with minor modifications, the preferred signal appearing on line 142 is a sawtooth signal with its higher-voltage excursion referenced to power supply line 130, and growing in amplitude towards ground potential with a decrease in engine speed. An increase in engine speed results in a shorter time between pulses appearing at the emitter of transistor Q1, capacitor C3 having less time to discharge, and the sawtooth voltage across capacitor C3 becoming smaller in amplitude. This sawtooth wave is referenced to power supply line 130 through transistor Q1. It should be specifically noted that diode D1, in the preferred embodiment of the invention, is a protective diode of an input of an unused integrated circuit logic gate, not shown, used to prevent the input from becoming more positive than its power supply line. This diode is shown as diode D1, its functional equivalent, for clarity of illustration.

The sawtooth waveform is supplied to an input 144 of integrated circuit logic IC2, acting as an inverter, with an input 146 connected to ground line 132. The signal appearing at output 148 of IC2 is a series of positive pulses which will be present whenever engine speed is below lower trigger level 124. Referring for a moment to FIG. 2, it will be noted that transitions of output signal I occur only when logic signal S1 first rises to its high voltage state. Therefore, the signal appearing at output 148 may be used as an equivalent to logic signal S1 shown on FIG. 2 without further processing.

The sawtooth signal appearing on line 142 is also applied to an input 150 of integrated circuit logic NOR gate IC3, and connected to junction 152 through a resistive voltage divider composed of the series combination of resistors R5 and R6, connected between line 142 and ground line 132. Integrated circuit logic NOR gates IC3 and IC4, together with integrated circuit logic gate IC2, provide the memory function shown as logic signal M in FIG. 2. As will be apparent, this circuit acts much like a circuit having hysteresis, providing a signal showing the result of a comparison between an input signal and a pair of reference levels such as upper and lower trigger levels 126 and 124. When the signal appearing at input 150 of logic gate IC3 exceeds the threshold of input 150, output 154 of logic gate IC3 will become a low voltage level, since, as will be explained, input 156 of logic gate IC3 is at a high voltage level. Output 154 is connected to a parallel combination of resistor R7 and diode D2, one end or resistor R7 and the anode of diode D2 being connected to output 154. The opposite end of resistor R7 and the cathode of diode D2 are connected to a point 158, which is connected to ground line 132 through capacitor C3.

As will be apparent, when output 154 is in a high voltage state, capacitor C3 will be charged through diode D2. When output 154 falls to a low voltage state, capacitor C3 discharges through R7 into output 154, maintaining point 158 at a high voltage level as it discharges. An input 160 of logic gate IC4 is connected to point 158. A second input 162 of logic gate IC4 is connected to output 148 of logic gate IC2. As will be apparent, a high voltage appearing at input 160 of integrated circuit logic gate IC4 will cause a low voltage to appear at output 164 of logic gate IC4. Output 164 being connected to input 156 of integrated circuit logic gate IC3, output 154 of logic gate IC3 will be forced to a high voltage state, maintaining point 158 high, output 164 and input 156 at a low voltage state, latching the circuit to provide, at point 158, a signal shown as logic signal M in FIG. 2, and the inverse of M appearing at output 164.

This simplification of a circuit according to the invention is due to the nature of the waveform appearing on line 142. The sawtooth being referenced to the supply voltage, and the amplitude of the sawtooth waveform becoming smaller with increasing frequency, so that capacitor C3 has proportionally less time to discharge through resistors R3 and R4, (and also R5 and R6,) so that the excursions of the sawtooth waveform toward ground reach the thresholds of inputs 144 or 150 at lower input frequencies, and are electrically above the thresholds at higher input frequencies. Therefore, as engine speed increases, the signal appearing at input 144 will change from a signal that is below a threshold of input 144 most of the time to a signal that is above the threshold of input 144 all of the time, causing a change in output 148. This same signal, attenuated by the voltage divider formed by resistors R5 and R6, appears at junction 152 and input 150 of logic gate IC3. In the preferred embodiment, this waveform is scaled so that it is above the threshold of input 150 of logic gate IC3 at all times when engine speed is above 1,000 RPM. Therefore, the output of logic gate IC3 will be a constant voltage until engine speed decreases through 1,000 RPM, at which time the negative-going excursions of the sawtooth wave will change the output of logic gate IC3, with the results described above.

As was stated above, the signal appearing at output 164 of logic gate IC4 is the inverse of that shown as logic signal M in FIG. 2. This signal is applied to the timer circuit composed of capacitor C4 and resistor R8. Resistor R8, connected between power supply line 130 and capacitor C4 at junction 166, holds that end of the capacitor in a normally high voltage status. The other end of the capacitor, connected to output 164 of logic gate IC4, is also at a high voltage level until the high limit of idle speed is crossed. Then, current flowing from capacitor C4 into output 164 of logic gate IC4 causes a lowering in voltage at junction 166. This lowering in voltage at point 166 is the logical equivalent of the inverse of the logic signal shown as timer function T on FIG. 2. Inputs 168 and 170 of logic NOR gate IC5 are connected to junction 166, with logic gate IC5 being used as an inverter. The inverted signal appearing at output 172 of logic gate IC5 is timer function T, as shown on FIG. 2. As will be apparent, timer function T is set and reset by the inverse of logic signal M, appearing at output 164 of logic gate IC4. In substance, the timer function T begins timing when a memory function M indicates that engine speed has crossed a low idle speed limit, and is reset, if not timed out earlier, when memory function indicates that engine idle speed has crossed a maximum idle speed limit.

Output 172 of logic gate IC5 supplies one of the signals to base junction 174 of output switch transistor Q2, through resistor R8. The timer function output from output 172 of logic gate IC5 is also applied to an input 176 of logic NOR gate IC6. The output 178 of logic gate IC6 will be the logical expression $\overline{T}\ M\ N$ when fully developed, and will be applied to base junction 174 of output transistor switch Q2 through resistor R9. The function $I=T+\overline{T}MN$ is thus developed at the base 174 of transistor Q2, which is turned on either by the function T through R8 or by function $\overline{T}\ M\ N$ through R9.

For the development of the function $\overline{T}\ M\ N$, the output 178 of logic gate IC6 is also connected to input 180 of logic gate IC7. The input 182 of logic gate IC7 is connected to output 148 of IC2, which contains a signal containing the significant portions of logic signal S1 shown on FIG. 2. Therefore, as indicated on FIG. 2 and the logic equations set forth above, output 184 of logic NOR gate IC7 will contain the logical inverse of memory function N shown on FIG. 2. This function from output 184 of logic gate IC7 is applied to a junction 186 through a resistor R10. Output 164 from logic gate IC4 is also connected to junction 186 through diode D3, and junction 186 is connected to input 190 of logic gate IC6, in a "wired-OR" configuration, containing the logical signal $\overline{M}+\overline{N}$, and since T is present at the other input 176 of NOR gate IC6, the output 178 is indeed $\overline{T}\ M\ N$ as stated above.

As will be apparent, memory function N is effectively set by logic signal S1, and reset by logic signal M. Diode D3 prevents irrelevant transitions of logic signal M from affecting input 190. For example, referring to FIG. 2 at a time just prior to t12 when the output 172 and input 176 are in a high voltage condition, output 178 and input 180 of IC7 are at a low voltage level and since the speed is above the lower trigger level, input 182 of IC7 will also be held at a low voltage making the output 184 remain at a high voltage. This voltage is applied through resistor R10 to input 190 thus latching output 178 in this low voltage condition even when, at time t12, the output 172 changes from high to low voltage. Therefore at a time just prior to time t13 on FIG. 2, the voltage at output 178 will be low. At the time t13, the speed goes below the lower trigger level and a series of positive pulses appear at input 182 causing output 184 to drop to a low voltage. Since output 164 is still held at a low voltage, the input 190 will change from a high to a low voltage, and with input 176 still at a low voltage level, output 178 will be changed from a low to a high voltage level which, being applied to input 180, will cause output 184, the inverse of the N function, to latch at a low voltage even when the voltage at input 182 returns to a low voltage state. Thus, logic function N is set by the positive transition of S1, through input 182.

Just prior to time t13 when S1 is maintained at a low voltage, if it is assumed that input 190 is high, output 178 will be low, output 184 being high and maintaining input 190 at a high voltage. When the speed is reduced to the lower trigger level, as at time t13, then a transition from a low to a high voltage appears on input 182, causing output 184 to go to a low voltage. Since outputs 164 and 172 are at a low voltage there is no support to keep input 190 at a high voltage, and when it goes low, output 178 goes to high voltage, holding output 184 low, even when input 182 returns to a low voltage level again. Thus, memory N is set by the rising transition of S1. At time t14, the output 164 of logic gate IC4 will become a high voltage, which represents the logical function M, forcing input 190 of logic gate IC6 to a high voltage, resulting in a low voltage at output 178. This low voltage, applied to input 180 of IC7, input 182 being a low voltage, forces output 184 of logic gate IC7 to a high voltage state. This high voltage applied to input 190 through resistor R10 maintains output 178 of logic gate IC6 at a low voltage, resetting memory function N. Thus, N is reset by a positive transition of M through diode D3.

Signals applied through resistor R8 and resistor R9 to base junction 174 cause transistor Q2 to become conductive, transistor Q2 having its emitter 192 connected to ground line 132. The collector 194 of transistor Q2 is connected to first control signal output 94 shown on FIG. 1, thus allowing current flow through the coil, not shown, of solenoid valve 62, energizing solenoid valve 62. First control signal output 94 is connected to temperature switch input 95 through a diode D4 as shown in FIG. 3. Therefore, either transistor Q2 or temperature switch 30 can maintain first control signal output 94 at a low voltage level, connecting vacuum source 64 to vacuum diaphragm actuator 58, to provide an increased throttle opening, temperature switch 30 overriding the command signals applied to base junction 174 of transistor Q2. A zener diode ZD2 is connected between first control signal output 94 and ground line 132, and is therefore effectively placed across solenoid valve 62 to prevent switching transients from solenoid valve 62 from damaging transistor Q2.

Diodes D5, D6 and D7 are connected between line 96 and accessory signal inputs 88, 90 and 92 respectively. Line 96, being a "wired-or" combination of inputs 88, 90 and 92, is applied to second control signal output 96, for maintaining movable idle stop member 52 in its operative position when a major accessory load is applied to the engine. A diode D8 is interposed between line 96 and ground line 132, for bypassing transients that may appear on second control signal 96 due to the inductive nature of solenoid 60.

As will be apparent, numerous modifications and variations of the disclosed embodiment of the invention will be apparent to one skilled in the art, and may be made without departing from the spirit and scope of the invention. Such modifications and variations may include substitution of other circuitry for implementing the various functions of the disclosed embodiment of the invention.

We claim:

1. An idle speed control for an internal combustion engine having a throttle valve and an ignition system, for permitting a lowered idle speed setting, comprising:

a movable idle speed stop member mounted on said engine for opening the throttle valve of the engine in response to stepwise movement of an actuator means;

said actuator means being capable of assuming a first position and a second position, said movable stop member opening said throttle valve a predetermined amount in said first position;

said actuator means including a vacuum diaphragm actuator and a solenoid actuator, said vacuum actuator being operably connected to a source of vacuum for causing said actuator means to assume said first position in response to a first output signal of a control device, said solenoid actuator being connected to a second output signal of said control device for causing said actuator means to be maintained in said first position;

said first output signal being responsive to a predetermined condition of said engine, said predetermined condition being indicative in part of said idle speed falling below a predetermined minimum speed;

said first output signal being maintained for a predetermined time after said idle speed has fallen below said predetermined minimum speed;

said first output signal being removed after said predetermined time and then being reapplied and maintained if said idle speed falls below said predetermined minimum speed;

said first output signal being disabled when said idle speed rises above a predetermined maximum idle speed.

2. An idle speed controller according to claim 1, wherein said control device includes:

means connected to said ignition system for providing a first signal having an amplitude proportional to engine idle speed;

first threshold logic means responsive to said first signal for providing an upper trigger level output signal when engine idle speed is below said predetermined maximum idle speed;

second threshold logic means responsive to said first signal for providing a lower trigger level output signal when engine idle speed is below said predetermined minimum idle speed;

first memory hysteresis means, said first memory means being connected to and set by said lower trigger level output, and being connected to and reset by said upper trigger level output, for causing said low limit output to be maintained until said engine idle speed is increased above said predetermined maximum idle speed;

timer means responsive to said low output signal for providing a timer output signal for a predetermined time after said engine idle speed falls below said predetermined minimum idle speed;

output memory means set by said timer output signal and by said low limit output signal, and being reset by said high limit output signal, for providing said first output signal.

3. An idle speed controller according to claim 2, wherein:

said first threshold logic means and said second threshold logic means are NOR logic gates.

4. An idle speed controller according to claim 3, wherein:

said second output signal of said control device is responsive to at least one of a plurality of predetermined loads imposed upon said engine.

5. An idle speed controller according to claim 1, wherein said control device includes:

filter means connected to said ignition system to provide a filtered speed signal;

first differentiator means, connected to the output of said filter means for providing a speed pulse signal;

integrator means responsive to said speed pulse signal for providing a first sawtooth signal having an amplitude proportional to engine idle speed;

first threshold logic means for providing a lower trigger level signal in response to said first sawtooth signal when the engine speed falls below said predetermined minimum speed;

voltage divider means responsive to said speed pulse signal for providing a second sawtooth signal with an amplitude proportional to engine speed;

second threshold logic means;

third logic means;

storage means operably connected to an output of said second threshold logic means and to a first input of said third logic means;

said second threshold logic means having a first input responsive to said second sawtooth signal and a second input responsive to an output of said third logic means;

said third logic means having a second input responsive to an output of said first threshold logic means for providing a last crossing output, said output being indicative of said engine speed passing through one of said predetermined minimum idle speeds and said predetermined maximum idle speeds;

timer means connected to said output of said third logic means for providing a timer signal initiated by said output of said third logic means and adapted to be reset by said output of said third logic means;

fourth logic means;

fifth logic means for providing an indication that timer signal has been initiated by said output of said third logic means and that said engine idle speed is below said maximum predetermined idle speed, said fifth logic means having a first input connected to an output of said fourth logic means and a second input connected to said low speed signal:

said fourth logic means having a first input connected to an output of said fifth logic means and to said last crossing output and a second input responsive to said timer signal and to a control signal output of said fourth logic means; and switch means connected to said output of said fourth logic means for providing said first output signal of said control device.

6. An idle speed controller according to claim 5, wherein:

said first threshold logic means, and said second threshold logic means, are NOR logic gates.

7. An idle speed controller according to claim 6, wherein:

said third logic means, said fourth logic means, and said fifth logic means are logic NOR gates.

8. An idle speed controller according to claim 7, wherein:

said switch means is a transistor.

9. A control circuit for providing a control signal to an actuator for intermittently increasing the idle speed setting of an internal combustion engine, comprising:

means for providing a speed signal having an amplitude proportional to engine speed;

first threshold means responsive to said speed signal for providing a lower trigger level signal in response to the idle speed of the engine falling below a predetermined minimum idle speed;

second threshold means responsive to said speed signal for providing an upper trigger signal in response to the idle speed of the engine rising above a predetermined maximum idle speed;

first memory means responsive to said lower trigger level signal and to said upper trigger level signal for providing a first memory signal indicating whether the engine speed is between the predetermined minimum idle speed and the predetermined maximum idle speed;

timer means responsive to said memory signal for providing a timer output signal for a predetermined time when the engine speed falls below the predetermined minimum idle speed;

second memory means responsive to said first memory signal and to said timer output signal and to said low limit signal for providing a logic output control signal for a predetermined time when the engine speed falls below the predetermined minimum engine idle speed, and reapplying and maintaining the output signal if the engine speed again falls below the predetermined minimum engine idle speed before rising above said predetermined maximum engine idle speed; and output switch means for providing a first output to said actuator.

10. A control circuit according to claim 9, wherein;

said engine has a plurality of accessory loads imposed thereon;

said control circuit being responsive to the imposition of said loads and including means for providing a second output to said actuator to maintain said actuator in an energized position after said output switch has provided said first output to said actuator to move said actuator to said energized position, until each of said plurality of accessory loads has been removed.

* * * * *